US006398334B2

(12) United States Patent
Dunand

(10) Patent No.: US 6,398,334 B2
(45) Date of Patent: Jun. 4, 2002

(54) PROCESS AND PRINTER WITH SUBSTRATE ADVANCE CONTROL

(75) Inventor: Alain Dunand, Grenoble (FR)

(73) Assignee: Imaje S.A., Bourg les Valence Cedex (FR)

( * ) Notice: Subject to any disclaimer, the term of this patent is extended or adjusted under 35 U.S.C. 154(b) by 0 days.

(21) Appl. No.: 09/726,813

(22) Filed: Nov. 30, 2000

(30) Foreign Application Priority Data

Dec. 3, 1999 (FR) ..... 99 15271

(51) Int. Cl.[7] ..... B41J 2/12
(52) U.S. Cl. ..... 347/14; 347/19; 347/78
(58) Field of Search ..... 347/14, 16, 19, 347/78, 74, 79

(56) References Cited

U.S. PATENT DOCUMENTS

| | | | | |
|---|---|---|---|---|
| 3,898,671 A | * | 8/1975 | Berry et al. | 347/76 |
| 4,321,607 A | | 3/1982 | Heibein et al. | 347/79 |
| 4,800,396 A | | 1/1989 | Hertz | 347/79 |
| 5,481,288 A | | 1/1996 | Keeling et al. | 347/80 |
| 5,828,387 A | * | 10/1998 | Wataya et al. | 347/14 |
| 6,003,980 A | * | 12/1999 | Sheinman et al. | 347/78 |

FOREIGN PATENT DOCUMENTS

| | | |
|---|---|---|
| EP | 0 036 789 | 9/1981 |
| EP | 0 589 718 | 3/1994 |
| EP | 0 863 012 | 9/1998 |

* cited by examiner

*Primary Examiner*—Craig A Hallacher
(74) *Attorney, Agent, or Firm*—Pearne & Gordon LLP

(57) ABSTRACT

Process for compensation of a defect in the advance of a print substrate by modifying the arrival position of ink droplets with a variable electrical charge on the substrate (27), these droplets being charged in a variable and sequential manner, the paths of the droplets being affected by deviation electrodes (23, 24) deviating the droplets to one of N positions defined by their row j ($1 \leqq j \leqq N$), the N positions defining a frame obtained by a burst of droplets in the form of a straight line segment parallel to an X direction along which the substrate advances. The process is characterized in that:

a current band is printed with a first mark on the substrate, the substrate is advanced to print the next band, an algebraic difference is determined between a nominal theoretical position of the mark and the real position of the mark, a correction to the value of the charge voltage to be applied to each droplet to compensate for the position error of the substrate is determined for each droplet in the burst, the substrate correction calculated for the droplet in the said row is applied to each droplet in the next band, in addition to the nominal voltage.

13 Claims, 8 Drawing Sheets

FIG. 5
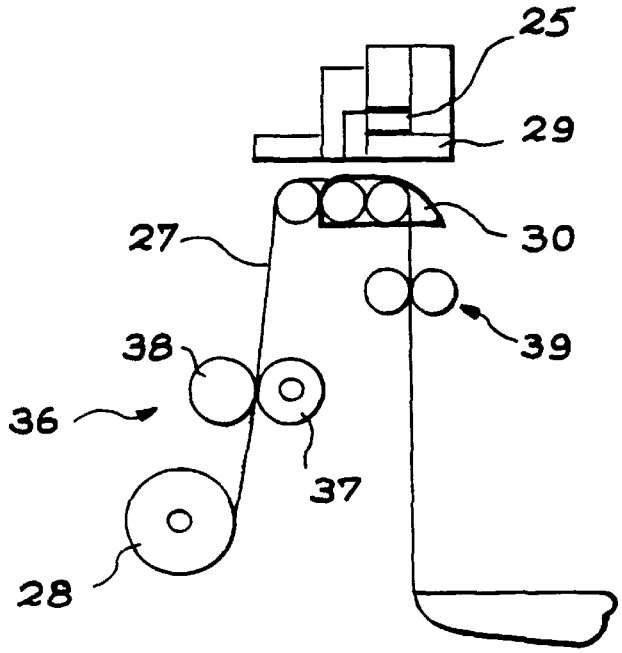
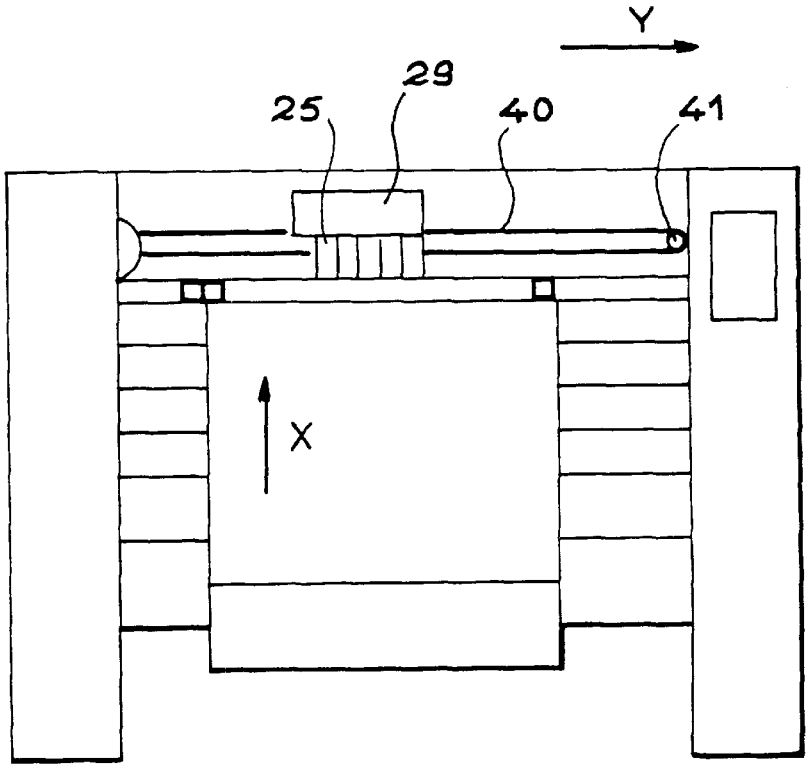
FIG. 6

PROCESS AND PRINTER WITH SUBSTRATE ADVANCE CONTROL

DOMAIN OF THE INVENTION

The present invention relates to inkjet printers in which ink droplets are formed and electrically charged and then deviated to strike a print substrate. It concerns a process intended to correct misalignment defects caused by the differences between the real advance of the substrate and its nominal advance, and a printer embodying such a process.

TECHNOLOGICAL BACKGROUND

It is known that a pressurized ink jet ejected through a print nozzle can be broken into a series of individual droplets, each droplet being individually charged in a controlled manner. Constant potential electrodes along the path of these individually charged droplets deviate the droplets by a variable amount depending on their charge. If it is not required that a droplet should reach the print substrate, its charge is controlled such that it is deviated to an ink recovery reservoir. The operating principle of this type of ink jet printer is well known, and for example is described in U.S. Pat. No. 4,160,982. As described in this patent and as shown in FIG. 1, this type of printer comprises a reservoir 11 containing electrically conducting ink 10 that is distributed through a distribution duct 13 to a droplets generator 16.

The role of the droplets generator 16 is to form a set of individual droplets starting from the pressurized ink in the distribution duct 13. These individual droplets are electrically charged by means of a charge electrode 20 powered by a voltage generator 21. The charged droplets pass through a space between two deviation electrodes 23, 24 and are deviated by a variable amount depending on their charge. The least deviated or undeviated droplets are directed to an ink recovery reservoir 22, whereas deviated droplets are directed to a substrate 27. The successive droplets in a burst reaching the substrate 27 can thus be deviated to an extreme low position, an extreme high position and any number of intermediate positions, the set of droplets in the burst forming a vertical line with height $\Delta X$ approximately perpendicular to a relative direction of advance between the print head and the substrate. The print head consists of the droplet generator 16, the charge electrode 20, the deviation electrodes 23, 24 and the recovery reservoir 22. In general, this head is enclosed in a casing not shown. The deviation movement applied to the charged droplets by the deviation electrodes 23, 24 is complemented by a movement along a Y axis perpendicular to the X axis, between the print head and the substrate. The time elapsed between the first and last droplets in a burst is very short. The result is that despite continuous movement between the print head and the substrate, it can be assumed that the substrate has not moved with respect to the print head during the time of a burst. Bursts are fired at regular intervals in space. If all droplets in each burst were directed towards the substrate, then a sequence of lines with height $\Delta X$ would be printed. In general, only some droplets in the burst are directed towards the substrate. Under these conditions, the combination of the relative movement of the head and the substrate, and the selection of the droplets in each burst that are directed towards the substrate, is a means of printing any pattern such as that shown in 28 in FIG. 1. If the line that is drawn with the droplets in a burst is in a direction X, the relative movement of the head and the substrate in the plane of the substrate is in a direction Y perpendicular to X. The undeviated droplets are directed to the recovery reservoir along a path Z perpendicular to the x, y plane of the substrate. Printed droplets reach the substrate by following paths slightly deviated from direction Z.

If the relative movement of the head and the substrate takes place continuously along the largest dimensions of the substrate, there will usually be several print heads printing bands parallel to each other. One example of this type of use is shown in FIGS. 1 and 2 in the patent issued to IBM, as number FR 2 198 410.

If the relative movement of the print head and the substrate in the Y direction takes place along the smallest dimension of the substrate, printing is done band by band, with the substrate performing an intermittent advance movement in the X direction after each scanning. The relative movement of the print head and the substrate is called the "scanning movement". The scanning movement is thus composed of a forward and return movement between a first edge of the substrate and a second edge of the substrate. The movement between one edge and the other edge of the substrate is a means of printing a band of height L, or frequently a part of the band of height $\Delta X$ where $\Delta X$ is usually a sub-multiple of L, without stopping. All bands printed in sequence thus form the pattern to be printed on the substrate. Each time that a band or a part of band is printed, the substrate is advanced by the distance between two bands or parts of bands to print the next band or part of band. Printing may be done during the forward movement only, or during the forward and return movements of the print head with respect to the substrate.

When the pattern to be printed is colored, the different shades of colors are the result of ink impacts from nozzles supplied by inks of different colors being superimposed and placed adjacent to each other. The system for relative displacement of the substrate with respect to the print heads is achieved such that a given point on the substrate is presented in sequence under each of the different colored ink jets. Usually, the print system comprises several jets of the same ink operating simultaneously, either by multiple heads being adjacent to each other or by the use of multi-jet heads, or finally by the combination of these two types of heads in order to achieve high print speeds. In this case, each ink jet prints a limited part of the substrate. The droplets may be produced continuously as described above in relation to FIG. 1. They may also be produced "on demand", in other words only when they are necessary for printing needs. In this case, a system for recovery of unused ink is not necessary. Known means of controlling the different jets will now be described with reference to FIG. 2.

The pattern to be printed is described by a numeric file. This file may be formed using a scanner, a calculator aided graphic creation pallet (CAD) transmitted using a calculator data exchange network, or it may simply be read from a peripheral reading a numeric data storage medium (optical disk, CD-ROM). The numeric file representing the colored pattern to be printed is firstly split into several binary patterns (or bitmaps) for each ink. Note that the case of the binary pattern is a non-limitative example; in some printers, the pattern to be printed is of the "contone" type, in other words each position may be printed by a variable number of droplets from 1 to M. Part of the binary pattern is extracted from the file for each jet corresponding to the width of the band that will be printed. FIG. 2, which shows the control electronics of a jet, shows a memory 1 in which the numeric pattern cut into bands is stored, this storage memory containing information about a color. For printing each band, an intermediate memory 2 contains the data necessary for printing the band with the said color. Descriptive data for the band to be printed are then input into a calculator 3 that calculates the charge voltages of the different drops that will form the band for this color. These data are input into the calculator in the form of a sequence of frame descriptions that, when combined, will form the band. The calculator 3 that calculates droplet charge voltages is often in the form of a dedicated integrated circuit. This calculator 3 calculates the sequence of voltages to be applied to the charge electrodes 20, in real time, in order to print a given frame defined by its frame description, as loaded from the intermediate memory 2. An output side electronic circuit 4, called the "droplet charge sequencer", synchronizes the charge voltages firstly with the times at which droplets are formed, and secondly with the relative advance of the print head and the substrate. The advance of the substrate with respect to the print head is materialized by a frame clock 5, the signal of which is derived from the signal from an incremental encoder of the position of the print unit relative to the substrate. The droplet charge sequencer 4 also receives a signal from a droplet clock 6. This droplet clock is synchronous with the droplet generator control signal 16. It is used to define transition instants of the various charge voltages applied to droplets to differentiate their paths. Numeric data originating from the droplets charge sequencer 4 are converted into an analog value by a digital analog converter 8. This converter outputs a low voltage level and usually requires the presence of a high voltage amplifier 21 that will power the charge electrodes 20. The illustrations of prior art given with reference to FIGS. 1 and 2 are intended to make the domain and benefits of the invention clear, but obviously prior art is not limited to the descriptions made with reference to these Figures. Other arrangements of electrodes and recovery reservoirs for unused ink droplets are described in a very extensive literature. An electromechanical arrangement of charge electrode print nozzles and deviation electrodes as described in invention patent number FR 2 198 410 issued to International Business Machine Corporation (IBM) with reference to FIGS. 1 to 3 in this patent could very well be used in this invention. Similarly, the electronic control circuit for the charge electrodes could be illustrated by the circuit described with relation to FIG. 4 in the same patent. Also, data to be printed need not necessarily be in the form of binary files, but they could be in the form of files containing words of several bits, to translate the fact that each position of the substrate may receive several ink droplets of the same color. It can be understood that for printing, and particularly for color printing, the necessary superposition of droplets originating from different nozzles outputting the different ink colors must be very precise. The main print defects that are generated by all known print systems are related to misalignments along the direction of the relative movement between the print head and the substrate. This defect appears as light or dark lines produced when printing in successive scans. These defects may appear in the space between two bands that in principle must be equal to the interval between two adjacent droplets in a single frame, or within a single band, in the space delimiting the areas printed by different jets, or even inside the frame printed by a jet at the space between two adjacent droplets in the frame. These misalignment defects may be caused either by defects specific to some jets in the print head (mechanical or electrical defects) or substrate positioning errors, or errors of the relative positioning between different print heads, or even between jets in the same print head. Various solutions have been proposed to limit or to eliminate misalignment problems, but all these solutions limit the print rate to a value below the nominal print rate, sometimes by a very high factor, or by redundant print heads and therefore at high cost. Some examples of frequently used known solutions for limiting misalignment will be described very briefly below; a first type of solution is based on fine mechanical adjustments of the positions of print heads by means of micrometric tables. This solution is expensive due to the necessary number of micrometric tables, and frequently painstaking due to the number of trial and error attempts that are necessary.

Another frequently used type of solution consists of using a very high overlap ratio between adjacent drops, in order to avoid white misalignments. These white misalignments correspond to the lack of coverage of the substrate. Dark misalignments are less easily seen and it is preferred to have a misalignment defect composed of dark lines rather than a misalignment defect composed of white lines. The solution consisting of increasing the overlap ratio between adjacent droplets is efficient to compensate for defects within a single band and to a certain extent misalignment defects between bands, but it has the disadvantage that it requires a very large quantity of ink per unit area of substrate and causes difficulties in drying or deformation of the substrate.

A third type of solution for eliminating misalignment defects on printers operating in scanning consists of printing the substrate partially during each scanning. The substrate is completely covered by increasing the number of times that the substrate is scanned. Printing in several passes in this way uses several strategies for interlacing the positions of droplets from different jets. One example of interlacing even and odd lines is given in patent number U.S. Pat. No. 4,604,631 issued to the RICOH Company. One advantage of this solution, frequently related to a high overlap ratio, is that it enables a substrate drying time, but it reduces the print rate by a factor of between 2 and 16.

The performances of colored graphic print systems are naturally moving towards higher and higher resolutions and rates, consequently there is an increasingly critical need to efficiently limit misalignment problems without making compromises that reduce print rates.

BRIEF DESCRIPTION OF THE INVENTION

The invention relates to the correction of a misalignment defect called a dynamic translation error $\phi$ due to the substrate advancing not enough or too much between two scans. It relates to printers in which the substrate is advanced step by step after each band has been printed.

According to the invention, a mark will be printed when printing each current band. This mark may consist of a single line printed by one or several droplets that may or may not be in consecutive rows. After the substrate has been advanced to print the next band, the error $\epsilon_x$ will be determined as the difference between the nominal position and the real position of the mark, corresponding to a difference in the advance of the substrate. This error in the advance of the substrate will be compensated by modifying the charge of the droplets printed in this band. This modification will create a path for each droplet that is different from the nominal path. If the modification to the charge is calculated correctly, this path will intersect the substrate surface at a position offset from the nominal position, in the direction opposite the offset in the advance of the substrate.

Therefore, the invention relates to a process for compensation of a defect in the step by step advance of a print substrate by modifying the arrival position of ink droplets on the substrate, these droplets being electrically charged in a variable and sequential manner using charge electrodes, applying a nominal voltage to each droplet as a function of its row in the frame, the droplets originating from a print head, the paths of the droplets being modifiable by deviation electrodes deviating the droplet to one of N nominal positions, between a first position $X_1$ and a last position $X_N$, and including N−2 intermediate positions, the N positions defining the frame in the form of a straight line segment parallel to an X direction of the substrate, characterized in that:

a current band is printed with a first mark on the substrate, the substrate is advanced to print the next band, after the substrate has advanced and before the next band is printed, an algebraic difference is determined between a nominal theoretical position of the mark and the real position of the mark, a substrate advance correction is determined for each droplet in the burst, consisting of a dynamic translation correction voltage $\phi$ to be applied to the value of the charge voltage to be applied to each droplet output from the head to correct the deviation of the droplets and compensate for the algebraic difference of the position of the substrate from its nominal position, the calculated dynamic translation correction voltage $\phi$ of the substrate position is applied to each droplet in the burst directed towards the substrate, in addition to the nominal voltage.

The invention also relates to a printer equipped with means of making the process according to the invention. It is a printer with a continuous deviated jet projecting droplets in rows 1 to N in the burst, the droplets in one burst possibly but not necessarily being directed towards a print substrate as a function of data defining a pattern to be printed, the printer having at least:

a print head, this head comprising means of separating at least one inkjet into droplets and an associated droplet charge electrode, means (23, 24) of deviating some of the droplets towards the print substrate, print control means, comprising means of injecting the charge to the droplets to be directed towards the substrate as a function of the rows of the droplets in the burst, coupled to the droplet charge electrode, characterized in that the print control means comprise at least a mark position detector, this detector outputting a representative value of a difference between a nominal advance and a real advance of the substrate and in that the print control means also comprise a calculator for calculating the dynamic translation correction voltage $\phi$ for the substrate advance, this calculator determining a dynamic translation correction voltage $\phi$ for the substrate advance for each droplet in a burst depending on its row, this correction voltage also taking account of a value of the substrate advance error output by means coupled to the detector and calculating values of errors from a nominal position, the calculator calculating the dynamic translation correction voltage $\phi$ for the substrate advance being coupled to droplet charging means, the droplets charging means taking account of the value of the dynamic translation correction voltage $\phi$ for the substrate advance generated by the calculator calculating the dynamic translation correction voltage $\phi$ for the substrate advance to modify the charge voltage of each droplet as a function of the dynamic translation correction voltage $\phi$ for the substrate advance.

BRIEF DESCRIPTION OF THE DRAWINGS

A printer including means of embodying the process according to the invention and other details of the process according to the invention will now be described with reference to the attached drawings in which:

FIGS. 5 and 6 are diagrams illustrating the hardware elements of a printer;

DETAILED DESCRIPTION OF AN EXAMPLE EMBODIMENT

If the substrate advance with respect to the print head is not equal to the nominal advance, a misalignment defect appears or is increased by the difference between the nominal position of the substrate and its real position. This difference and its effects are shown in FIG. 3.

Figure 3:
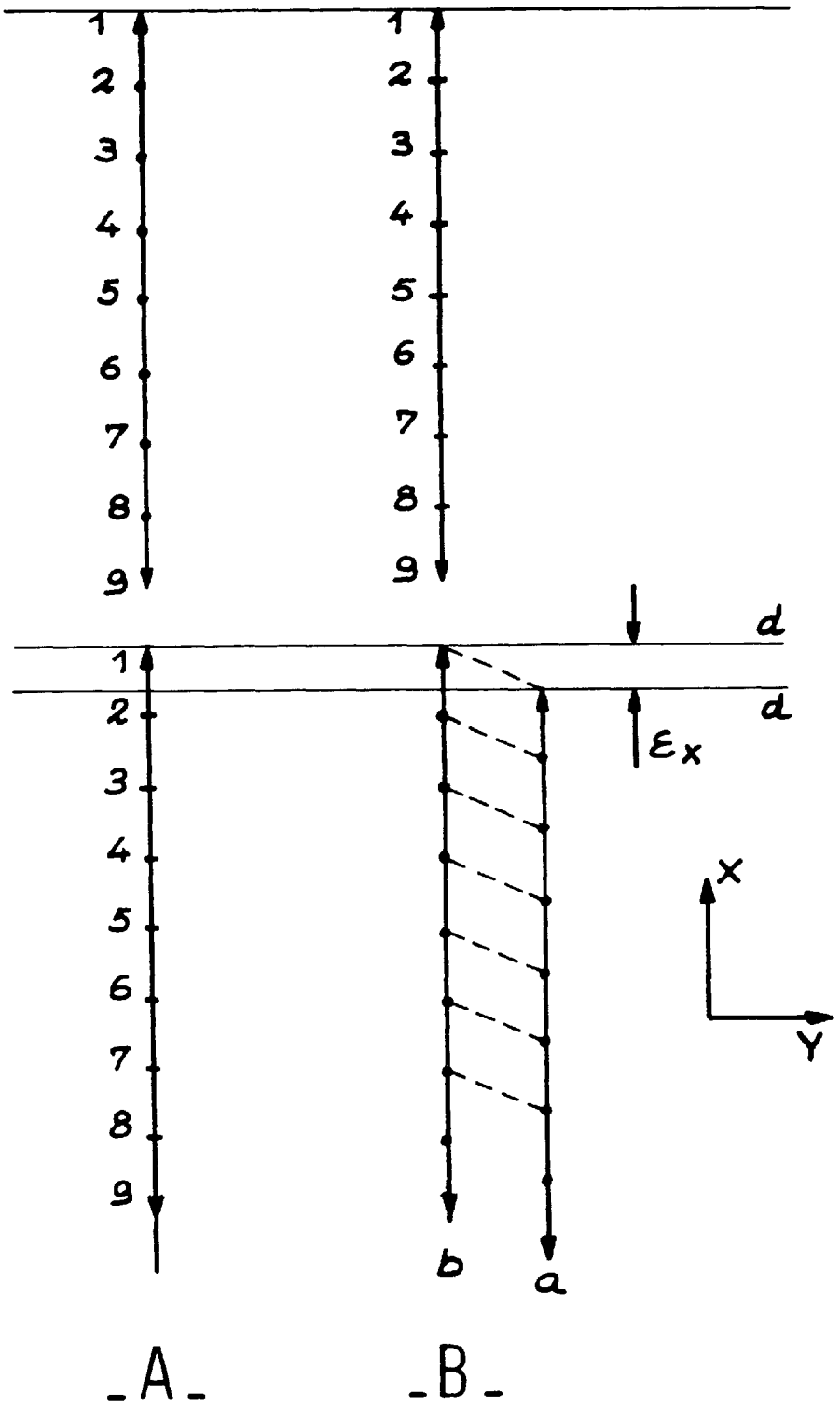
FIG. 3 is a diagram explaining the misalignment defect due to a substrate advance defect and the method of correction according to the invention.

Part A in FIG. 3 shows two frames of nine droplets numbered from 1 to 9 represented in their nominal position by dots. These two frames form part of two consecutive bands, a current band at the top and a next band at the bottom and are therefore shown parallel to the X axis. The bands extend along the Y direction. Normally, the spacing between consecutive bands is equal to the distance between two consecutive droplets in a burst.

Part B shows two frames, one belonging to the current band and the other to the previous band. The frame in the next band has been doubled up into a first frame a representing a frame in the real position and a second frame b representing the nominal position of the next band along the X axis. For the needs of the Figure, frames a and b are offset from each other along the Y direction. However, it should be understood that these frames are normally in line with each other along the X direction. It will now be assumed that there is a defect in the substrate advance with respect to the print head when changing from the current band to the next band, with the result that the substrate has advanced too far and is offset from its nominal position by a quantity ex. The result is that all frames in the next band will be offset from their nominal position by $\epsilon_x$ and consequently a white misalignment defect will be materialized as shown in FIG. 3 by two straight lines d separated from each other by a distance $\epsilon_x$. There would be a black misalignment defect if the movement of the substrate between the two bands was smaller. The correction will consist of modifying the charge voltage on each droplet in the next band so as to modify its path through the deviation electrodes. The change to the path is such that the real position of each frame in the current band after the correction has been made will be shifted by $\epsilon_x$ to compensate for the substrate advance defect. Although each droplet in each frame is moved by the same distance $\epsilon_x$, the dynamic translation correction $\phi$ to be applied to each droplet depends on the row of the droplet in the frame.

Figure 4:
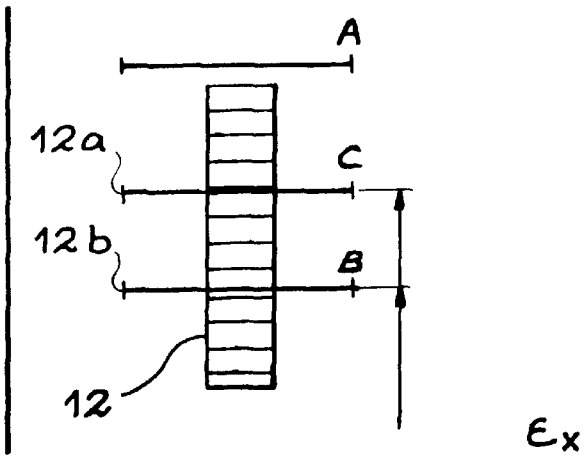
FIG. 4 is a diagram intended to explain the method of correcting substrate advance differences.

As explained above, this result will be obtained by printing a first mark shown at A in FIG. 4 when printing a current band. This mark may be composed of a single line printed using one or several droplets in a subsequent row.

After the substrate has advanced, mark A is moved and occupies the position shown at B in FIG. 4. In order to materialize the error $\epsilon_x$ in the substrate advance, the position of a dummy mark has also been shown at C representing the nominal position that mark A would have had if there had been no difference between the nominal position and the real position. The mark C is not present on the substrate in a real manner. The difference between the dummy mark C and the mark at position B is used to determine the error $\epsilon_x$ between the nominal position marked at C and the real position marked at B. This difference in the substrate advance will be compensated according to the invention by modifying the charge of the droplets printed during the next band.

When the next band is printed, another mark will be printed taking account of the real advance of the substrate, in the same way as for the printing of the current band. The result will be that there will be the nominal spacing between all marks and bands.

The error $\epsilon x$ between the mark B and the nominal position C of the band that will be printed will be detected using a sensor 12, for example a CCD detector capable of measuring this difference, for example by counting the difference in the number of a sensor element 12*a* that receives the mark when it is in the nominal position, and a sensor element 12*b* that actually receives it. This sensor will preferably be placed facing the substrate and laid out such that its measurement field is capable of detecting the mark with fairly wide tolerances. Preferably, this sensor will be a sensor with a given light wavelength and will be used in cooperation with a transmitter, transmitting this determined wavelength towards the substrate.

FIGS. 5 and 6 are principle diagrams for colored pattern printers using an ink jet, showing some features necessary for embodiment of the invention.

The system illustrated in FIGS. 5 and 6 shows an architecture for printing large formats solely for non-limitative examples. Printing is done by successive scanning in the Y direction. The system uses a substrate 27 starting from a coil 28 in a known manner, the advance of the substrate on the output side of the print unit 29 being controlled by a pair 36 of drive rolls 37, 38 in contact.

A first roll 37 is motor-driven, and a second roll 38 applies counter pressure at the contact point. The two rolls 37, 38, trap the substrate and drive it with no slip. An encoder, not shown since it is known in itself, checks the advance of the substrate 27, using angular positions mounted on the spindle of one of the rolls. After each intermittent advance of the roll, the area on the substrate to be printed is held flat on a print table 30 located under the scanning path of the print unit 29. It is held flat by means of a second drive system 39 on the output side of the print unit.

This second drive system 39 keeps a constant tension on the substrate 27. An intermittent vacuum is sometimes applied to the print table to improve the flatness of the substrate 27 in the print area.

Figure 1:
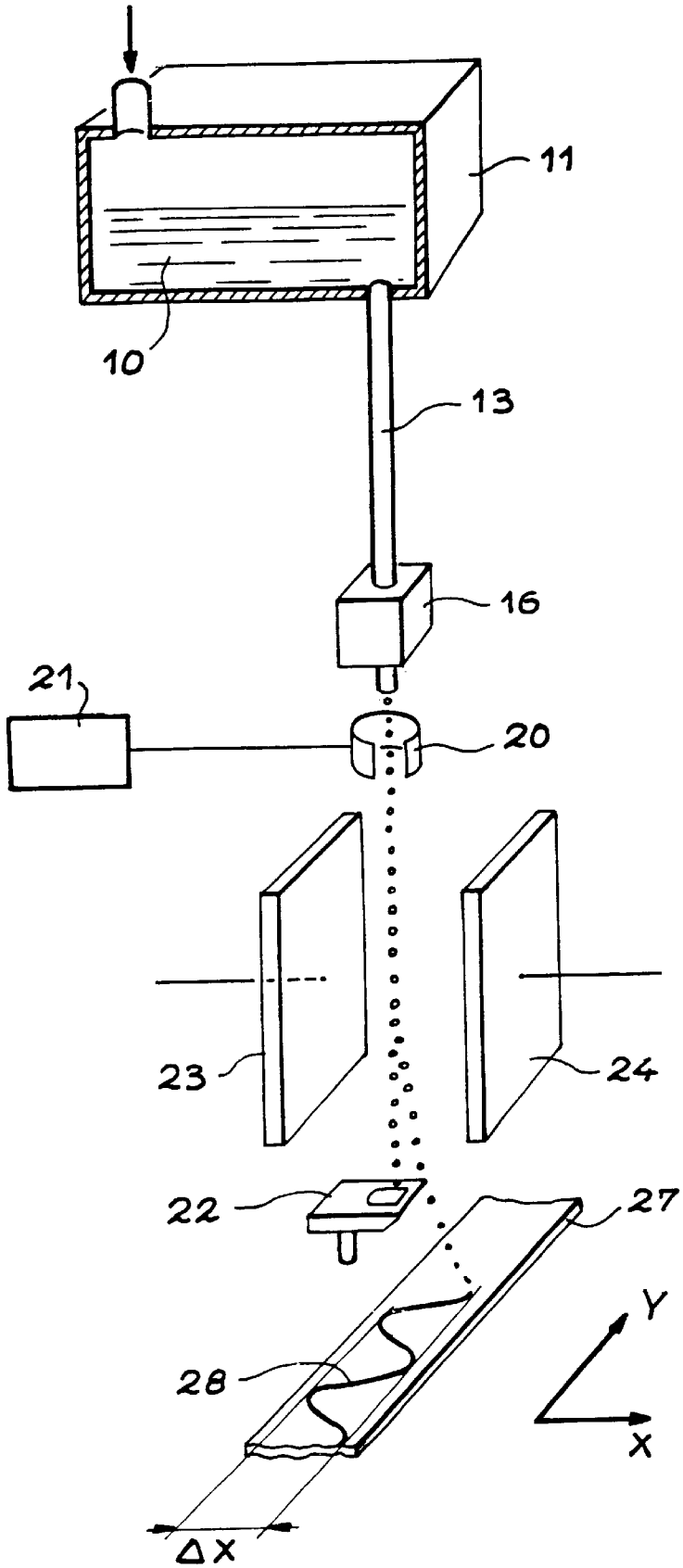
FIG. 1, already described is a diagrammatic representation of the means necessary to create ink droplets and to deviate them towards a substrate.

The ink jet print unit 29 is composed of several print heads 25, for example as shown in FIG. 1, each head being supplied by one of the primary colored inks from reservoirs 11 using an umbilical cord or distribution duct 13.

The different print heads 25 print on the substrate simultaneously when it is not moving. The print unit prints a band by scanning in the Y direction. The scanning movement of the print unit with respect to the substrate is achieved by a belt 40 fixed to the print unit and driven by a motor-driven pulley 41. The print unit is guided in a known manner by a mechanical spindle not shown.

Each print head prints a band with constant width L. Print heads can be offset in the direction X along which the substrate advances such that a head does not necessarily print the same band at the same time as another print head corresponding to a different colored ink. After each scan, the substrate is advanced by a distance increment $\Delta X$ equal to not more than the band width L, but more generally equal to a sub-multiple of L for printing in several passes.

The spacing of print heads along the Y direction and possibly along the X direction firstly enables a sufficient drying time between deposition of different ink colors, and secondly enables an order for identical superposition of colors even when printing is done during the forward and return movements of the print head.

Compared with the print system shown in FIGS. 5 and 6, the invention according to this embodiment has the special feature that it is equipped with a detector 12 detecting the real advance of the substrate. The position of this detector 12 with respect to the substrate and the print heads is commented below in relation to FIGS. 8 to 10.

Figure 8:
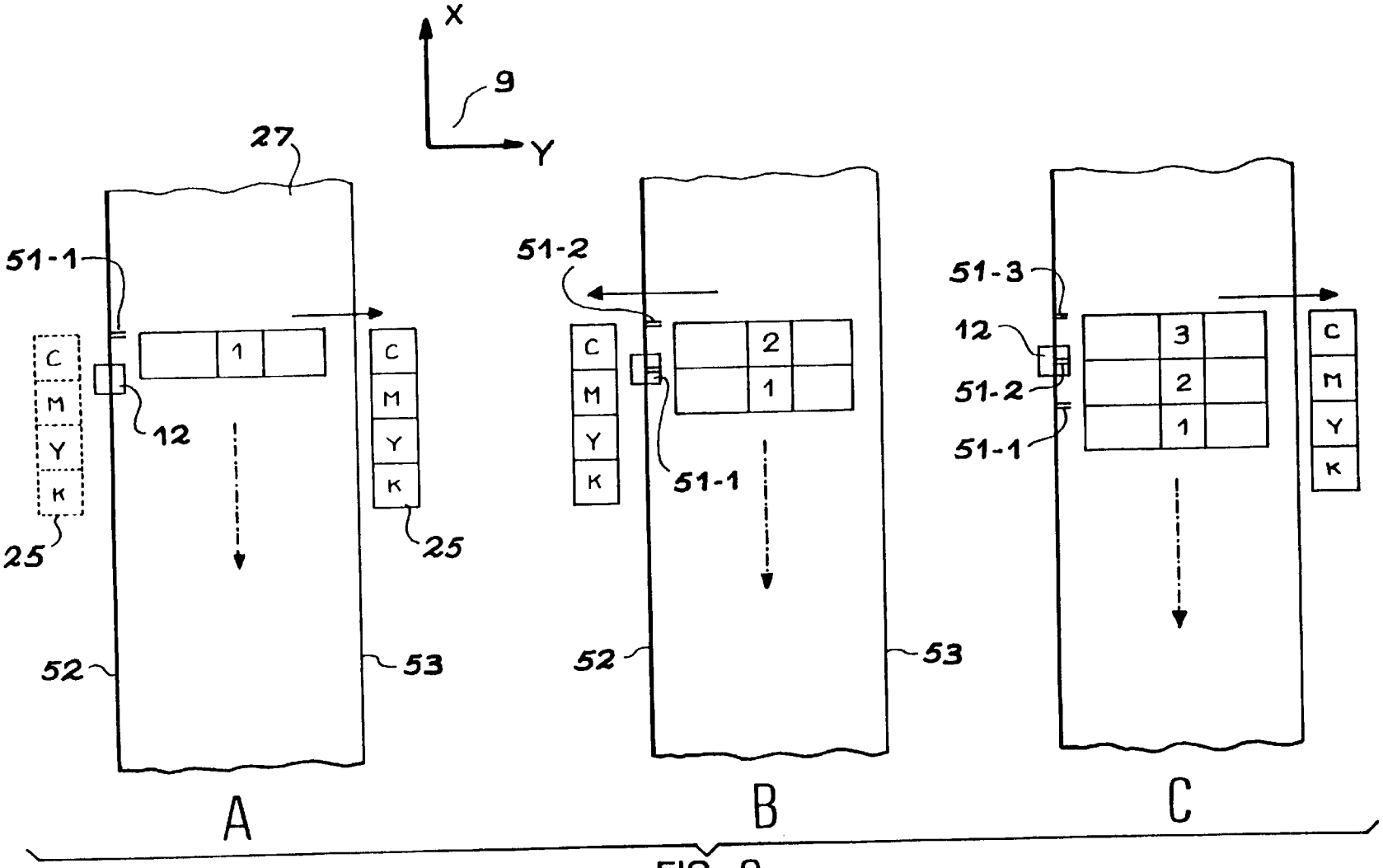
FIG. 8 contains parts A, B and C, each part corresponding to one phase in the print sequence for successive bands.

FIG. 8 comprises parts A, B and C each corresponding to one phase in the sequence to print a set of bands.

Figure 10:
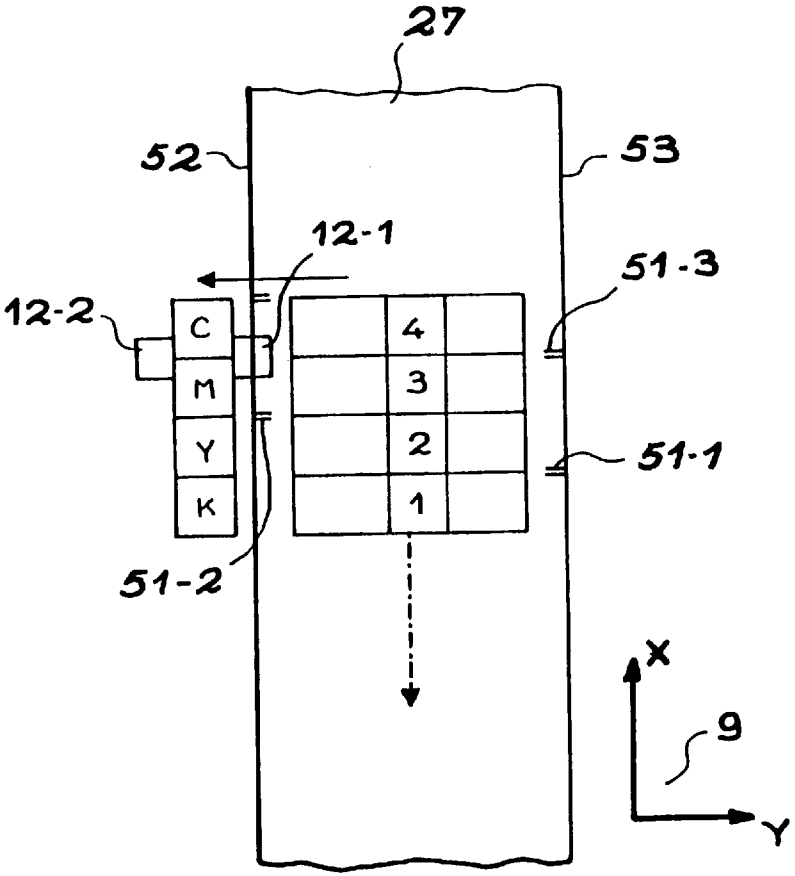
FIG. 10 illustrates the case in which two sensors are installed on each side of a carriage supporting print heads, one on the paper input side and one on the paper output side.
Figure 9:
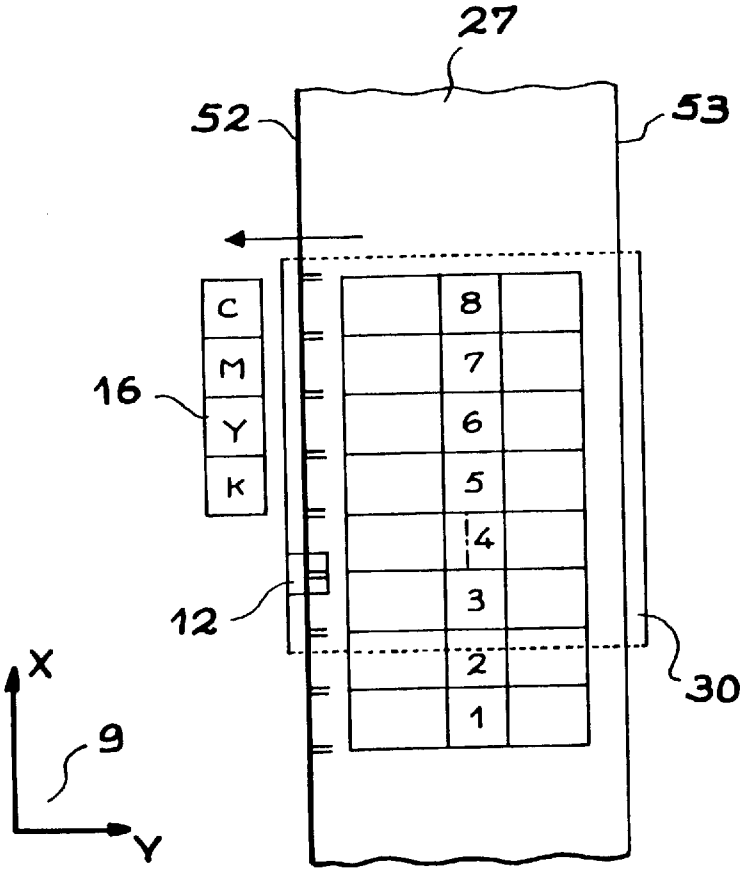
FIG. 9 illustrates a case in which a mark sensor is mechanically attached to a print table holding the substrate facing the print heads.

In the positioning mode described with relation to FIG. 8, the detector 12 is fixed, for example fixed to a support device for the bar along which the print heads 16 are translated. FIGS. 8 to 10 show four print heads 25, one for each of the colors, cyan marked C, magenta marked M, yellow marked Y and black marked K. The support device for the translation bar is not shown since its geometry is different for each printer. In any case, it is only an example. An expert in the subject will be able to find or create a support for attachment of the detector, knowing that this detector is required to perform the functions described below.

The detector must be capable of detecting a mark 51 printed by one of the print heads 25 between the left edge 52 or right edge 53 of the substrate 27 and the beginning or end of the printed pattern, respectively.

Part A in FIG. 8 shows a first band mark 1 printed while the print heads 25 were moving between a first edge 52, the left edge in the Figure and a second edge 53, the right edge of the substrate in the Figure, as shown by an arrow parallel to the Y scanning direction and perpendicular to the X direction along which the substrate 27 advances.

As shown on parts A, B and C in FIG. 8, the detector 12 is placed at the edge of substrate 27 close to the print head 25 located in the second position among the heads. The second position is determined by counting the heads along the Y direction along which the substrate 27 advances. The first head is the head that is at the least distance along the direction along which the substrate advances.

The height of the detector 12 above the substrate, along a Z direction perpendicular to the plane of the substrate, is less than the height of the lower parts of the print head to leave room for them to pass. The proximity of the substrate gives better reading precision.

We will now explain how to use the marks 51 and the detector 12, with relation to the print sequence.

The cyan head 25 prints the mark 51-1 before a first band mark 1 is printed. This same cyan head then prints the band 1 in the scanning direction shown by an arrow in the direction Y. Before scanning, the heads 25 are located in the position shown as dashed lines on the left part of FIG. 8 part A. At the end of the scan, the heads 25 are located in the position shown as solid lines to the right of substrate 27.

The last step in the sequence is to advance the substrate 27 by one step. Mark 51-1 is located in the field of detector 12. Detector 12 detects a difference in the advance of the substrate with respect to the nominal advance, and the calculation means 34, 35 calculate corrections to be made to the droplet charge voltages for the cyan head and the magenta head so that the modification to the droplet paths compensates for the variation in the substrate advance.

In the head return movement, the magenta head 25 prints the second color on band 1 and the cyan head 25 prints the second band and then the mark 51-2. At the end of the return scan, the heads 16 are once again located at the first edge as shown on part B.

The substrate is moved forwards again, such that the mark 51-2 reaches the field of detector 12 as shown in part C in FIG. 8.

The detector detects if mark 51-2 is not in its nominal position.

Then, mark 51-3 and the third band are printed by the input side cyan head, while scanning from the first edge 52 towards the second edge 53. The magenta head 25 prints the second band with droplet charge voltage corrections to take account of the value of the latest error $\epsilon X$, while the yellow head Y prints the first band.

At the end of the third scan, the heads 25 are on the side of the second edge 53. The cycle continues. The substrate is moved forwards. The detector detects if there is a difference between mark 51-3 and its nominal position. A correction is applied taking account of this variation to charge the black head droplets that will be printed by superposition on the first band, to the yellow head Y that will print the second band and to the magenta and cyan heads that will print the third band and the mark 51-4 followed by the fourth band, respectively.

The cycle thus continues modulo the number of adjacent print heads, for example four in the case shown with reference to FIG. 8.

The sequence described above relates to a printout in which the heads print during the forward scan movement and during the return scan movement.

The sequence will be the same for printing in the forward scan only, the substrate being advanced at the same time as the heads return towards the first edge 52.

Note that the operation described above implicitly assumes that the accumulated algebraic sum of the substrate advance errors remains low.

In order to overcome large differences in the substrate advance, the substrate advance motor control may include a servocontrol that takes account of substrate advance errors. This servocontrol, well known to an expert in the subject, may be of the "proportional integral and derivative" type, i.e. it takes account of real errors, accumulated real errors and their variation with time in order to prevent drift.

Bands can be satisfactorily superposed at all times by reading marks, the determination of the substrate advance error and the correction of frames.

A software improvement is designed to guard against an unplanned blockage of the substrate advance due to causes other than a failure of the substrate movement and traction systems, detected elsewhere.

If the substrate is blocked, the mark printed while printing a current band and that will be used as a position reference for printing the next band, will not arrive in the field of detector 12. Therefore, the detector 12 will reuse the mark that was used for printing the current band with the same corrections, such that if the blockage or quasi-blockage of the substrate is not detected, the next band will be printed overlapping the previous band.

To prevent this type of overlapping, the printed pattern of marks in the even row is different from the pattern of marks in the odd row. Another case in which it is useful to distinguish the current mark from the next mark is the case in which these two marks would be simultaneously visible on detector 12, for example one on an extreme part of the detector on the input side and the other on an extreme part of the detector on the output side along the direction in which the substrate is moving. This situation can arise if the accumulated advance error reaches a positive value or negative value equal to half a nominal advance. In this case, the program will choose to use the reference mark to print the next band.

If a blockage or quasi-blockage is detected, the program could trigger another substrate advance command and then trigger an alert if the blockage is detected again, or otherwise immediately trigger an alarm.

The pattern of marks in even row bands and odd row bands will depend on the detector.

For example, if the detector only comprises one band of detector elements, the number of lines printed in the even patterns will not be the same as the number of lines printed in the odd patterns, the difference between the lines being such that each line is detected by a different sensor element. Alternatively, the same number of lines could be printed, but with different spacings between lines corresponding to different numbers of sensor elements detecting these lines. If the sensor 12 comprises sensor elements laid out in a matrix pattern, or if sensor 12 is mobile in the X scanning direction as described later, the even or odd patterns could also be distinguished by variations in the scanning direction, for example the use of dots for one and lines for the other, or different spacings of the same pattern.

FIG. 8 was used to describe details of the principle of measuring and controlling the substrate advance. In practice, the substrate mark detector must be placed on the output side of the print head that prints the marks, but in a location compatible with its size. Thus, positioning the sensor in an area scanned by print heads as shown in FIG. 8 would require a very fine mechanical adjustment such that the print head would pass above the sensor during scanning without any risk of hitting it. Furthermore, this positioning can create difficulties with the repetitiveness of conditions under which the mark is illuminated at the sensor, depending on whether the head is located at the right edge or the left edge of the substrate when the mark has been detected/measured. In practice, the printer comprises a print table under the substrate in the areas scanned by the print heads, to hold the substrate firmly in position. Therefore, the sensor could be positioned in a fixed position on the output side of the last print head, but in a location in which the substrate is firmly held in position by he print table. This can give satisfactory operation without any demanding constraint on the size or illumination of the sensor.

This position is shown in FIG. 9. The detector 12 is mechanically coupled to the print table 30 immediately on the output side of the print head 25.

Instead of being printed by the input side head, the mark is printed by the output side black K head, in the example shown.

Except for this difference, the print sequence is the same as described with relation to FIG. 8.

When the substrate advance is difficult, or when the print table is no longer sufficiently large, it is useful to use two sensors installed on each side of the print head. Each sensor, called the "left" and "right" sensors respectively, will detect the mark printed on the left edge of the substrate when printing the mark for the even scan made from the right edge towards the left edge, or the mark printed on the right edge of the substrate when printing the mark for the odd scan made from the left edge towards the right edge.

This case is shown in FIG. 10. The detector 12 is supported by the mobile mechanical assembly fitted with print heads that will be called the carriage in the following.

This Figure shows the case of a printer printing in a forward scan and a return scan. In this case, the carriage comprises two detectors, one detector 12-1 on the input side of the print heads during a forward scan and a detector 12-2 on the output side of the print heads during a return scan. This is why detectors 12-1 and 12-2 are located on each side of the print heads 25.

The operation is slightly different from the operation of a fixed detector located close to one of the substrate edges.

Mark 51-1 is always printed at the end of a scan. The result is that marks for odd rows are all on the side of the second edge 53 and marks for even rows are all on the side of the first edge 52.

Thus, for example mark 51-1 printed at the end of the first scan on the second edge 53 of the substrate 27, is detected by detector 12-2 that is on the input side of the print heads 16 during the return scan. Droplet charge corrections are made and band number 2 is printed and then mark 51-2 is printed close to the first edge. After the substrate 27 is advanced, this mark 51-2 is detected by detector 12-1. The observed difference is used to correct the printout of band 3 and the mark 51-3 printed at the end of the scan. This solution has the advantage that detectors are easier to position, and that there is a distinction between the positions of even and odd marks. The disadvantage is that an additional detector 12 is necessary. Switching is necessary to switch the input of means 34, 35 to detector 12-1 or 12-2, and can be done by software by changing the read address of the substrate error information $\epsilon_x$.

Figure 2:
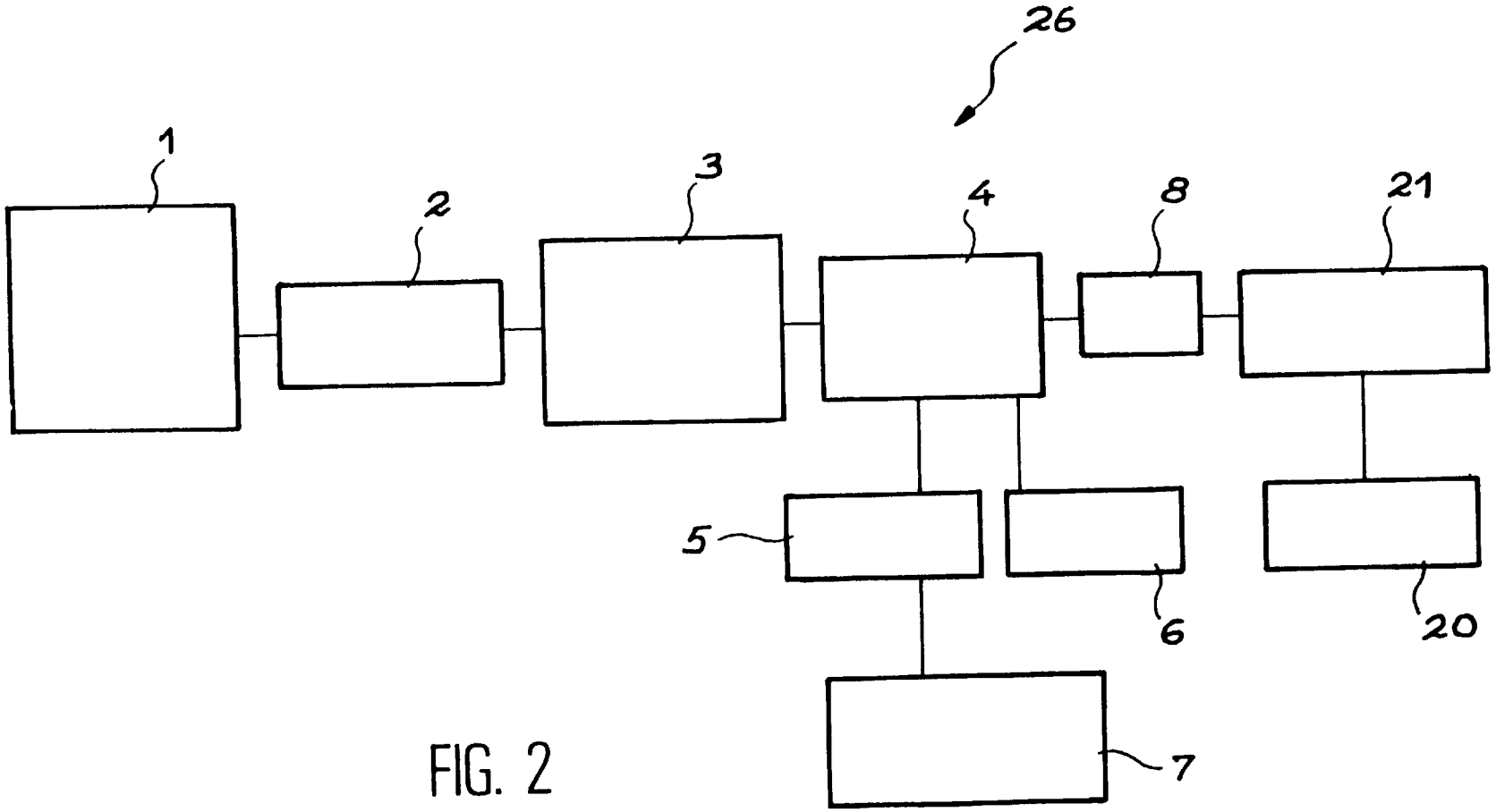
FIG. 2, already described by FIG. 1 in the description of prior art, shows all calculation means necessary for operation of the various means shown in FIG. 1.

Another important difference between a printer according to the invention and a known printer is related to the means of controlling the voltage of the droplet charge electrode. A device according to prior art was described above in relation to FIG. 2.

Figure 7:
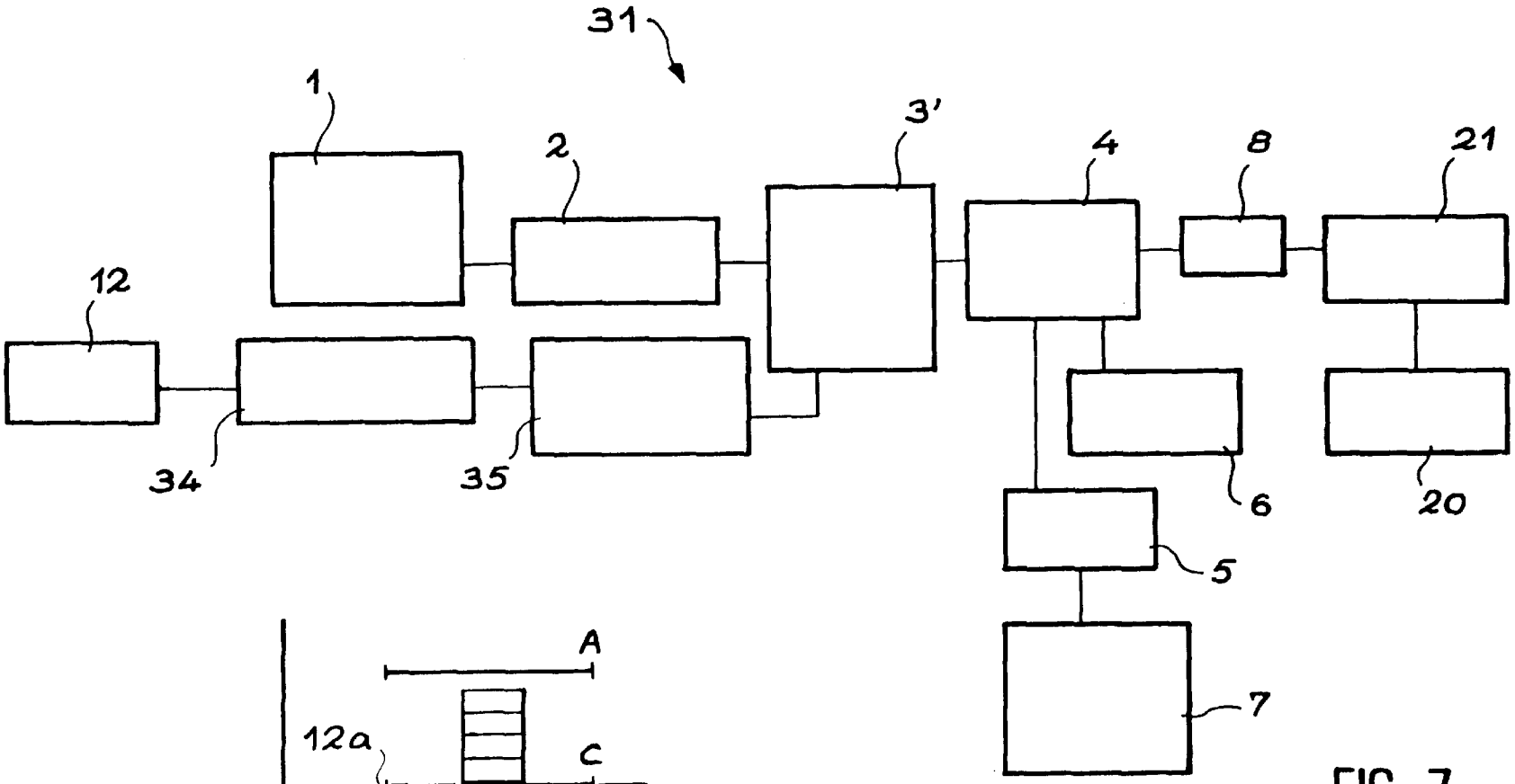
FIG. 7 is a diagram showing the calculation means for a printer using the process in the invention.

FIG. 7 shows control means 31 according to the invention. In these print control means 31, elements with the same function as the elements shown in FIG. 2 have the same reference number. Compared with print control means 26 shown in FIG. 2, the device according to the invention comprises the detector 12 detecting the difference between the real advance of the substrate and its nominal advance. Therefore the print control means 31 will also comprise a calculator 34 calculating the substrate position error. The detectors 12 and the position error calculator 34 are connected to each other in series and to a calculator 35 calculating the dynamic translation correction voltage $\phi$ for the substrate advance. The dynamic translation corrections $\phi$ determined by the calculator 35 as a function of the value of the error $\epsilon_x$ from the real position of the substrate compared with its nominal position as a function of the row j of the droplet, are applied to the droplet charge voltage calculator 3'. The calculation of the additional charge voltage to be applied to each droplet in the burst as a function of its row may make use of memorized additional voltage values to be applied to correct the errors $\epsilon_x$ given in an errors table. These values may be interpolated as a function of the real difference. The calculation may also use an algorithm using data known to the printer manufacturer such as the unit mass of the droplets, the value of the electrical field created by the voltage at deviation electrodes, the relation between the position of the droplets as a function of the voltage applied to the charge electrodes 20, in addition to the error $\epsilon_x$.

The operation is as follows.

The detector 12 detects the difference between a mark for the current band that will be printed and the nominal position of this band. This difference is input into the error calculator 34 that calculates the value $\epsilon_x$ of the substrate 27 advance error, as a function of the signal transmitted by sensor 12. This error is input into the dynamic translation calculator 35 that will calculate corrections to be applied to the droplet charge voltage calculator 3' to correct this dynamic translation. The droplet charge voltage calculator 3' will calculate the algebraic sum of the voltages to be applied to the droplet charge electrode by adding the nominal voltage resulting from the frame description originating from memory 2, and the value of the correction resulting from the difference correction made by the calculator 35 calculating the dynamic translation correction $\phi$.

Another function of calculator 34 relates to recognition of the mark and processing of information transmitted by sensor 12 to deduce a variation of the mark from its nominal position. It was mentioned briefly above that one simple procedure for determining the value of the substrate advance error consists of counting the number of sensor elements between the sensor element corresponding to the nominal position number 0 and the sensor element that receives the mark. This implicitly assumes that the thickness of the mark is of the same order of magnitude as the resolution of the sensor. Under these conditions, the error is determined by the number of the sensor element that detects the mark, if there is only one element. If the mark is detected as overlapping two sensor elements, the error is calculated as being a function of the number of the closest sensor element that perceives the mark, plus an increment that uses the distance between two sensor elements and, for example, the ratios of current from each of the two sensor elements concerned.

Figure 11:
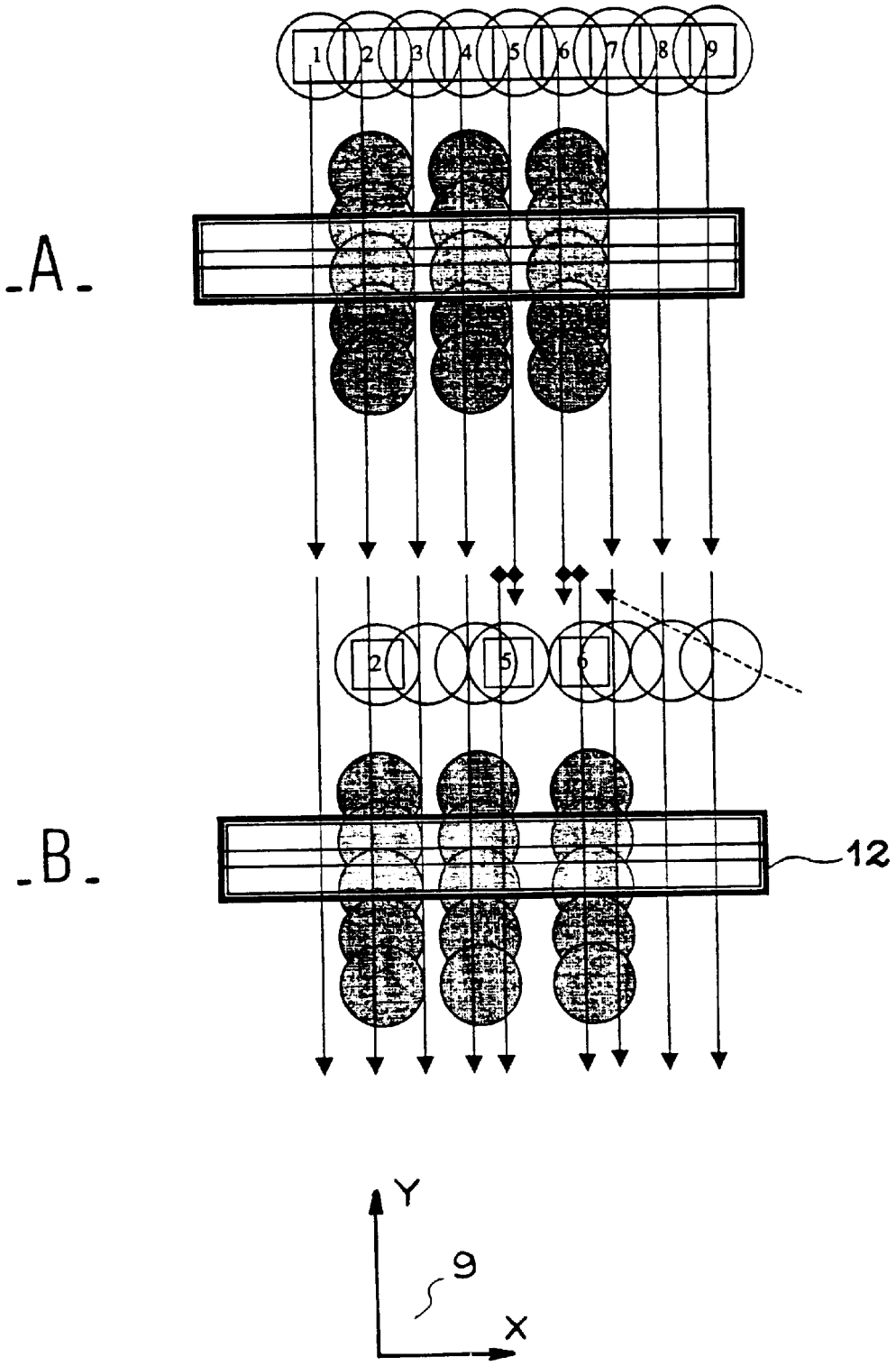
FIG. 11 is an illustration of the method of determining an exact position of the substrate advance mark, starting from the calculation of the center of gravity of the image of the mark on the detector.

FIG. 11 shows an example embodiment showing different cases that can arise and their processing method when the sensor resolution is greater than the droplet diameter.

In FIG. 3, the droplets are shown by dots with exaggerated spacing between each other to facilitate understanding. Unlike what was shown in FIG. 3, each droplet in FIG. 11 is shown by a circle to show adjacent droplets in a single frame overlapping each other in a printout. The positions of the droplets in a frame are numbered from 1 to 9 above each of the parts A and B in FIG. 11.

In the example shown in FIG. 11, the mark is composed of several lines (three in the example referred to in the description), plotted showing the different droplets in a burst, for example the droplets corresponding to positions 2, 4 and 6 of a 9-droplet burst.

In the various cases, the difference from the nominal position will be calculated by calculator 34 starting from the calculation of the position of the projection of the center of gravity of mark 51 onto an X axis parallel to the direction in which the substrate advances.

This center of gravity is determined considering the sensor elements that detect the mark. If the droplets are in their normal position as shown in part A in FIG. 11, the measurement will be precise. If the droplets in row 6 are offset from their nominal position as shown in part B, the error will be reduced.

In the case of mobile position detectors as discussed in relation to FIG. 10, the mark positions may be measured by taking samples while the print head is scanning, thus improving the precision of the measurement.

Note that in the case in which there are two detectors, each of the detectors 12.1 and 12.2 may be located on each side of the print table 30, the detector on the side of the table 30 detecting marks 51 located on the first edge 52 of the substrate and the detector located on the other side of the table 30 detecting marks 51 placed on the second edge 53 of the substrate 27. This layout of two detectors has the advantage that the even row marks can be distinguished from odd row marks by their position, and their shapes can be identical. The choice of putting detectors on the print head support carriage or on each side of the table 30 will depend on criteria specific to the mechanical characteristics of the printer and/or the control software.

What is claimed is:

1. Process for compensation of a defect in the step by step advance of a print substrate by modifying the arrival position of ink droplets on the substrate (27), these droplets being electrically charged in a variable and sequential manner, the droplets originating from a print head and being charged by charge electrodes (20) connected to a voltage generator (21), the paths of the droplets being affected by deviation electrodes (23, 24) deviating the droplets as a function of their electrical charge to one of N nominal positions defined by their row j, between a first position $X_1$ and a last position $X_N$, and including N−2 intermediate positions, the N positions defining a frame in the form of a straight line segment parallel to an X direction of the substrate, characterized in that:

a current band is printed with a first mark on the substrate, the substrate is advanced to print the next band, an algebraic difference is determined between a nominal theoretical position of the mark and the real position of the mark, a substrate advance correction is determined for each droplet in a burst, consisting of a dynamic translation correction voltage $\phi$ to be applied to the value of the charge voltage to be applied to each droplet output from the head to correct the deviation of the droplets and compensate for the algebraic difference of the position of the substrate from its nominal position, dynamic translation correction $\phi$ for the calculated substrate position for the droplet in the said row is applied to each droplet in the next band, in addition to the nominal voltage to be applied to the droplet as a function of its row in a frame.

2. Process according to claim 1, characterized in that the marks on the even row bands and the marks on odd row bands have at least one characteristic that can be used to distinguish them from each other.

3. Process according to claim 2, characterized in that a characteristic for distinguishing between even and odd marks is a mark shape characteristic.

4. Process according to claim 2, characterized in that a characteristic for distinguishing between even and odd marks is a position characteristic.

5. Process according to claim 4, characterized in that the even row marks are on a first edge of the substrate and the odd row marks are on a second edge opposite to the first edge.

6. Process according to claim 1, characterized in that one mark is printed at the beginning of a current band and its position is detected before the next band is printed.

7. Process according to claim 1, characterized in that a mark is printed at the end of a current band and its position is detected before the next band is printed.

8. Process according to claim 1, characterized in that a mark is printed on a second edge of the substrate at the end of a current odd band, in that its position is detected at the beginning of the next band, and in that a mark is printed on a first edge of the substrate opposite to the second edge at the end of a current even band.

9. Process according to claim 1, characterized in that the position of the mark is calculated as being the projection of the position of a center of gravity of the mark along the substrate advance direction.

10. Printer with a continuous deviated jet projecting droplets in rows 1 to N in the burst, the droplets in one burst possibly but not necessarily being directed towards a print substrate as a function of data defining a pattern to be printed, the printer having at least:

a print head, this head comprising means of separating at least one inkjet into droplets and an associated droplet charge electrode (20), means of deviating some of the droplets towards the print substrate (27), print control means (31), comprising means of injecting the charge to the droplets to be directed towards the substrate (27) as a function of the rows of the droplets in the burst, coupled to the droplet charge electrode (20), characterized in that the print control means (31) comprise at least a mark position detector, this detector outputting a representative value of a difference between a nominal advance and a real advance of the substrate and in that the print control means (31) also comprise a calculator (35) calculating the dynamic translation correction voltage $\phi$ for the substrate advance, this calculator determining a dynamic translation correction $\phi$ for the substrate advance for each droplet in a burst depending on its row, this correction voltage also including a value of the substrate advance error output by means coupled to the detector and calculating values of errors from a nominal position, the calculator (35) calculating the dynamic translation correction voltage $\phi$ for the substrate advance being coupled to droplet charging means, the droplet charging means taking account of the value of the dynamic translation correction voltage $\phi$ for the substrate advance generated by the calculator calculating the dynamic translation correction voltage $\phi$ for the substrate advance to modify the charge voltage of each droplet as a function of the dynamic translation correction voltage $\phi$ for the substrate advance.

11. Printer according to claim 10, characterized in that a first detector is mechanically coupled to the print table (30), in order to detect marks printed on a first edge (52) of the substrate.

12. Printer according to claim 11, characterized in that a detector is mechanically coupled to the print table to detect marks printed on a second edge of the substrate opposite the first edge.

13. Printer according to claim 10, characterized in that it comprises two detectors mechanically coupled to the print heads.

* * * * *